US010673143B2

(12) United States Patent
Osawa et al.

(10) Patent No.: US 10,673,143 B2
(45) Date of Patent: Jun. 2, 2020

(54) ANTENNA STRUCTURE, PORTABLE ELECTRONIC DEVICE, AND FREQUENCY ADJUSTMENT METHOD OF ANTENNA STRUCTURE

(71) Applicant: SEIKO EPSON CORPORATION, Tokyo (JP)

(72) Inventors: Seiji Osawa, Minowa-machi (JP); Tadashi Aizawa, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 248 days.

(21) Appl. No.: 15/875,426

(22) Filed: Jan. 19, 2018

(65) Prior Publication Data

US 2018/0205138 A1 Jul. 19, 2018

(30) Foreign Application Priority Data

Jan. 19, 2017 (JP) ..... 2017-007315

(51) Int. Cl.

| | |
|---|---|
| ***H01Q 9/42*** | (2006.01) |
| ***H01Q 9/04*** | (2006.01) |
| ***H01Q 1/24*** | (2006.01) |
| ***H01Q 1/27*** | (2006.01) |
| ***G04R 60/10*** | (2013.01) |
| *H01Q 1/38* | (2006.01) |

(52) U.S. Cl.

CPC ..... *H01Q 9/0442* (2013.01); *G04R 60/10* (2013.01); *H01Q 1/243* (2013.01); *H01Q 1/273* (2013.01); *H01Q 9/0421* (2013.01); *H01Q 1/38* (2013.01); *H01Q 9/42* (2013.01)

(58) Field of Classification Search

CPC ..... H01Q 9/0421; H01Q 9/0442; H01Q 1/273

See application file for complete search history.

(56) References Cited

U.S. PATENT DOCUMENTS

| | | | | |
|---|---|---|---|---|
| 2002/0098970 | A1* | 7/2002 | Tomomatsu | C01G 29/00 501/139 |
| 2004/0196195 | A1 | 10/2004 | Yuanzhu | |
| 2004/0252064 | A1 | 12/2004 | Yuanzhu | |
| 2006/0220957 | A1* | 10/2006 | Tanaka | H01Q 1/273 343/700 R |
| 2011/0156964 | A1* | 6/2011 | Lin | H01Q 1/243 343/702 |
| 2015/0109172 | A1* | 4/2015 | Iijima | H01Q 1/273 343/702 |

FOREIGN PATENT DOCUMENTS

| | | | |
|---|---|---|---|
| JP | 2003-332831 | A | 11/2003 |
| JP | 2004-312166 | A | 11/2004 |
| JP | 2005-005866 | A | 1/2005 |
| JP | 2013-150112 | A | 8/2013 |

* cited by examiner

*Primary Examiner* — Daniel Munoz
(74) *Attorney, Agent, or Firm* — Oliff PLC

(57) ABSTRACT

An antenna structure (GPS antenna) includes a plate-shaped conductor element (antenna electrode), a plate-shaped element (circuit board) including a ground conductor portion disposed so as to overlap the conductor element in plan view, and a skeletal resin frame for frequency adjustment disposed between the conductor element and the ground conductor portion.

14 Claims, 11 Drawing Sheets

ANTENNA STRUCTURE, PORTABLE ELECTRONIC DEVICE, AND FREQUENCY ADJUSTMENT METHOD OF ANTENNA STRUCTURE

This application claims the benefit of priority from Japanese Patent Application No. 2017-007315 filed Jan. 19, 2017, the entire contents of which are incorporated herein by reference.

BACKGROUND

1. Technical Field

The present invention relates to an antenna structure, a portable electronic device including the antenna structure, and a frequency adjustment method of an antenna structure.

2. Related Art

In a case where a global positioning system (GPS) receiver is incorporated in a casing of a compact portable electronic device such as a wristwatch, it is necessary to minimize the volume of the antenna used for the receiver as small as possible. In the related art, an antenna called a plate inverted F-type antenna has been proposed.

For example, in an inverted F-type antenna disclosed in JP-A-2004-312166, a plate-like radiating conductor plate is disposed on a plate ground conductor surface, and the radiating conductor plate and the ground conductor surface are connected by a feeding conductor plate and a short-circuit conductor plate.

Further, for example, in a plate inverted F-type antenna disclosed in JP-A-2005-005866, a plate radiation conductor portion is disposed so as to cover a circuit board on which a grounding pattern (GND layer) is stacked, and a feeding conductor portion and a short-circuit conductor portion derived from a radiation conductor portion are connected to the circuit board.

Further, for example, a plate inverted F-type antenna disclosed in JP-A-2003-332831 is configured with a rectangular conductor plate attached to a dielectric block (polymer or the like), and a feeding side terminal and a ground side terminal which are bent. It is described that in the inverted F-type antenna, a frequency adjustment region is provided on a rectangular conductor plate, the region is cut out and a notch or a slit is provided to adjust a reception frequency (resonance frequency).

However, in a case where the notch is provided on the rectangular conductor plate in order to adjust the reception frequency (resonance frequency), the rectangular conductor plate functioning as the radiation plate has an area which is small as much as the cut-out part, the amount of radiation is reduced, and a large amount of current flows around the notched region to increase the resistance value, which results in an increase in power consumption and leads to a loss of electric power for radio waves.

SUMMARY

An advantage of some aspects of the invention is to provide an antenna structure in which the loss of power for radio waves, that is, sensitivity deterioration of an antenna is reduced by adjusting a receiving frequency.

The invention can be implemented as the following forms or application examples.

Application Example 1

An antenna structure according to this application example includes a plate conductor element, a plate element including a ground conductor portion disposed so as to overlap the conductor element in plan view, and a skeletal resin frame for frequency adjustment disposed between the conductor element and the ground conductor portion.

According to this application example, since the conductor element itself functioning as a radiating plate is not cut out because the skeletal resin frame is used as a frequency adjustment portion, the antenna structure that maintains good reception sensitivity without impairing electric power for radio waves can be realized.

Application Example 2

In the antenna structure described in the application example, it is preferable that the resin frame includes a plurality of blocks.

According to this application example, it is possible to easily adjust the reception frequency (resonance frequency) of the conductor element, by cutting off one of the plurality of blocks included in the resin frame.

Application Example 3

In the antenna structure described in the application example, it is preferable that the plurality of blocks are connected by beams.

According to this application example, it is possible to easily cut off one of the plurality of blocks in a simple manner, by cutting off a beam part connected to each of the plurality of blocks.

Application Example 4

In the antenna structure described in the application example, it is preferably satisfied that $\tan\delta \leq 0.001$, when the dissipation factor of the resin frame is $\tan\delta$.

According to this application example, an antenna structure capable of maintaining good reception sensitivity without the radiation efficiency of the antenna structure decreasing can be realized.

Application Example 5

In the antenna structure described in the application example, it is preferable that the plate element is a circuit board.

According to this application example, since a ground conductor portion is provided on the circuit board, the space efficiency can be further increased, and a small antenna structure can be obtained.

Application Example 6

In the antenna structure described in the application example, it is preferable that a short circuit unit which is connected to the conductor element and the ground conductor portion includes a plurality of connection portions.

According to this application example, since the conductor element and the ground conductor portion are connected by the short circuit unit including the plurality of connection portions, a short circuit between the conductor element and the plate element can be more reliably performed.

Application Example 7

A portable electronic device according to this application example includes the antenna structure described in any one of the above application examples.

According to this application example, since the antenna structure that maintains good reception sensitivity without impairing electric power for radio waves is included by using the skeletal resin frame as a frequency adjustment portion, it is possible to realize a portable electronic device which is small in size and stable in reception performance.

Application Example 8

It is preferable that the portable electronic device described in the above application example includes a display unit disposed so as to overlap the antenna structure.

According to this application example, since the display unit is disposed so as to overlap the antenna structure, the display unit can be shielded without decreasing the shielding effect.

Application Example 9

In the portable electronic device described in the application example, it is preferable that at least a part of an outer edge region of the antenna structure protrudes outward beyond the outer edge of the display unit in plan view.

According to this application example, since the display unit and the antenna structure overlap more reliably, the shielding effect can be exerted more reliably.

Application Example 10

In the portable electronic device described in the application example, it is preferable that the display unit is any one of a liquid crystal display, an organic EL display, and an EPD.

According to this application example, it is possible to realize a compact portable electronic device realizing clearer display.

Application Example 11

In the portable electronic device described in the application example, it is preferable that the antenna structure is attached to a holding frame that holds an outer edge portion of the display unit.

According to this application example, since the antenna structure is attached to the holding frame that holds the outer edge portion of the display unit, a supporting portion of the antenna structure is not required, and a smaller portable electronic device can be realized.

Application Example 12

A frequency adjustment method according to this application example is a frequency adjustment method of an antenna structure which include a plate conductor element, a plate element including a ground conductor portion, and a skeletal resin frame including a plurality of blocks for frequency adjustment, the method including connecting the conductor element and the plate element, which are disposed to overlap in plan view, with a short circuit unit; placing the resin frame between the conductor element and the ground conductor portion; measuring a resonance frequency of the conductor element; and adjusting the frequency such that the resonance frequency of the antenna structure is within a predetermined frequency range by cutting off one of the plurality of blocks, based on the measured resonance frequency.

According to this application example, the frequency is adjusted to match the resonance frequency, by cutting off one of the plurality of blocks of the skeletal resin frame disposed between the conductor element and the plate element, which are disposed so as to overlap in plan view, based on the measured resonance frequency of the conductor element. Therefore, since the conductor element itself functioning as a radiating plate is not cut out to adjust the resonance frequency, the antenna structure that maintains good reception sensitivity without impairing electric power for radio waves can be realized.

Application Example 13

In the frequency adjustment method of an antenna structure described in the application example, it is preferable that in the adjusting the frequency, each of the plurality of blocks is correlated in advance with a frequency variation amount due to cut-off, a block to be cut off from the plurality of blocks is specified depending on the frequency adjustment amount, and the block is cut off.

According to this application example, since a block to be cut off is specified by comparing the frequency adjustment amount which is the difference between the target resonance frequency of the conductor element and the measured resonance frequency with the pre-set frequency variation amount of each block, it is possible to cut off the corresponding block simply and easily.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment according to the invention will be described. In addition, the embodiment described below does not unfairly limit the contents of the invention described in the appended claims. Further, not all of the configurations described in the present embodiment are necessarily essential constituent elements of the invention.

In addition, in the present specification, a wrist device is exemplified and described as an embodiment of the portable electronic device according to the invention. For convenience of explanation, in the following description, the side located on the side in contact with the user when the wrist device is attached to the user is referred to as "a back side or a back surface side", and the display surface side of the wrist device which is the opposite side is referred to as "a front side or a front surface side". Note that the wrist device according to the embodiment can be widely applied to a runner's watch, a runner's watch for multi-sport competitions such as duathlons and triathlons, and a GPS watch provided with a GPS which is a satellite positioning system, for example, a global navigation satellite system.

Embodiment

Figure 1:
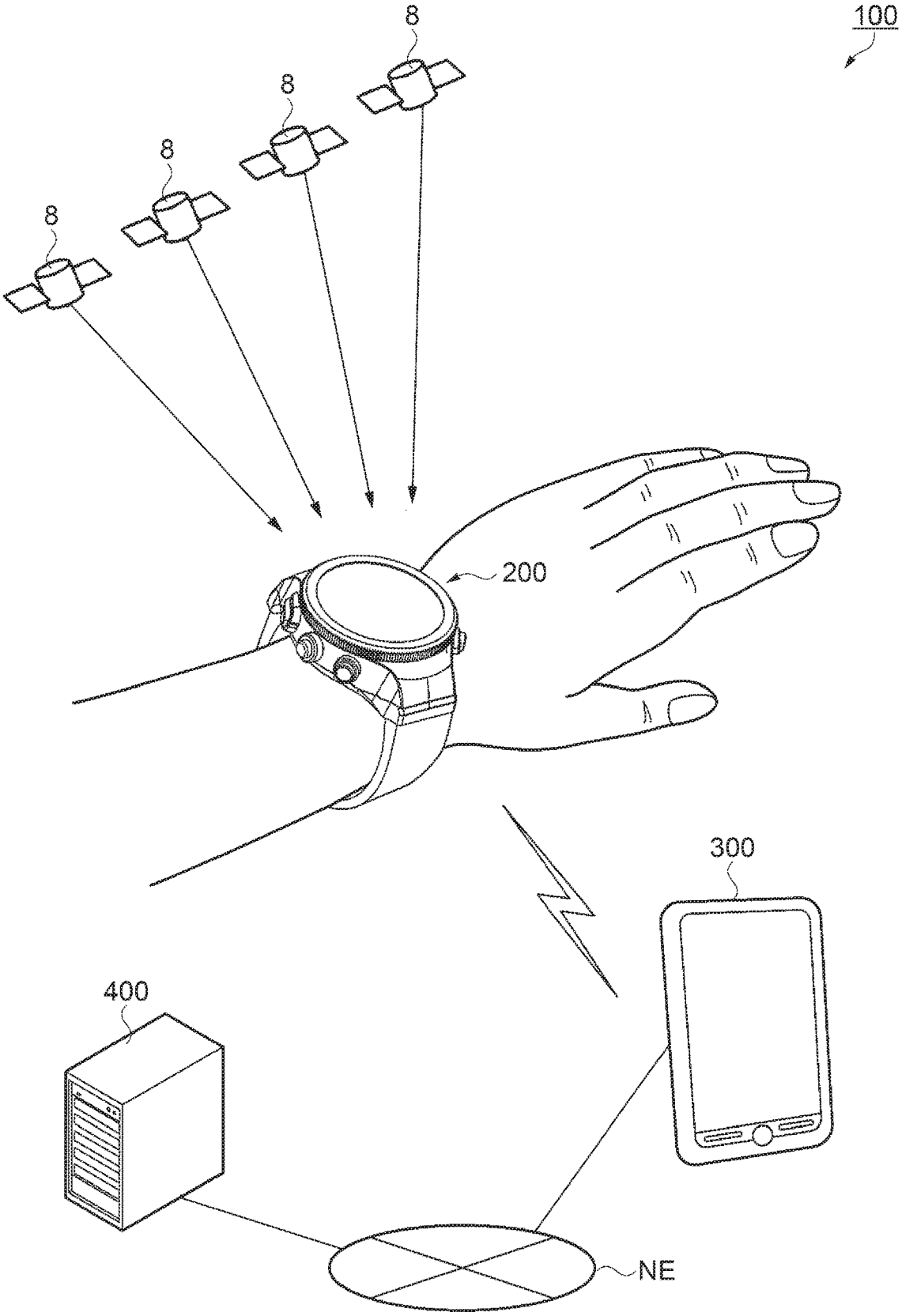
FIG. 1 is a schematic configuration diagram showing an outline of an exercise support system to which a wrist device as an example of a portable electronic device using an antenna structure according to the invention is applied.
Figure 2:
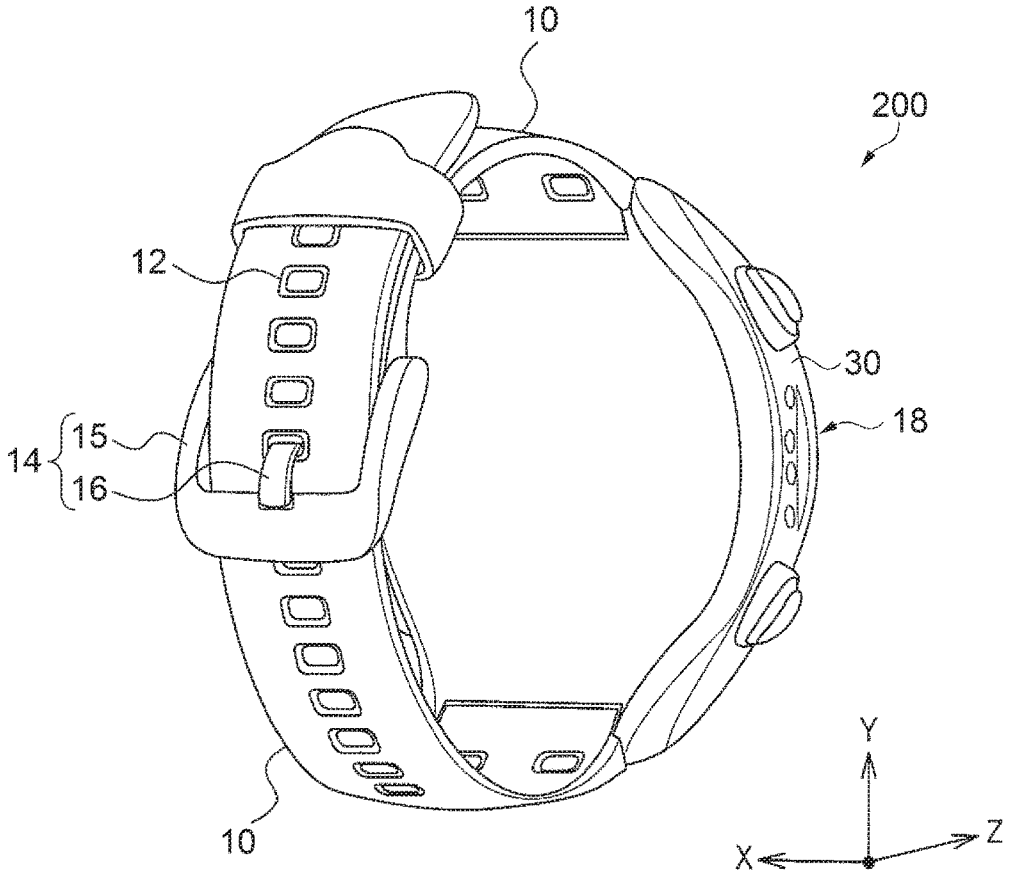
FIG. 2 is an external view showing a schematic configuration of the wrist device.
Figure 3:
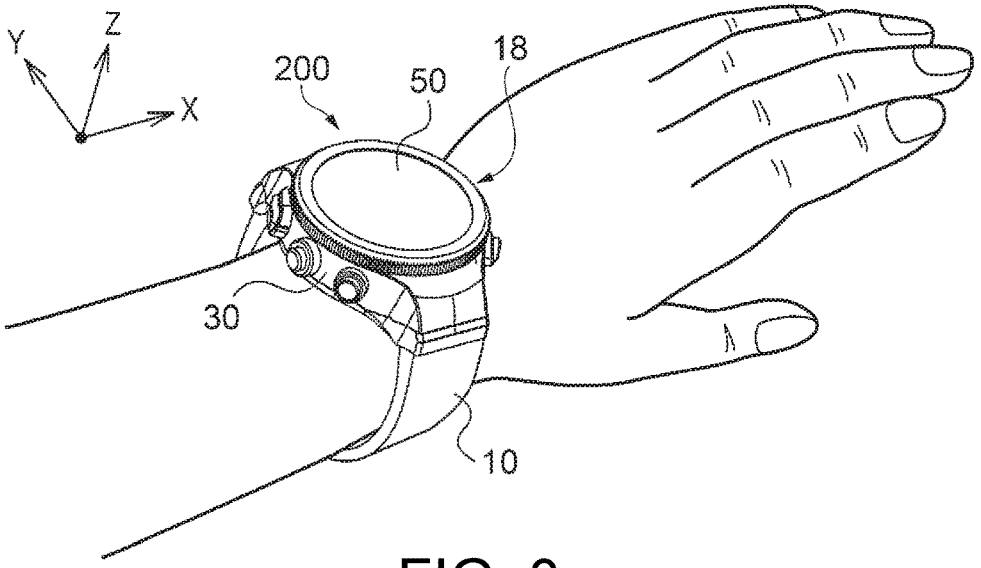
FIG. 3 is an external view showing an example of attachment of the wrist device.
Figure 4:
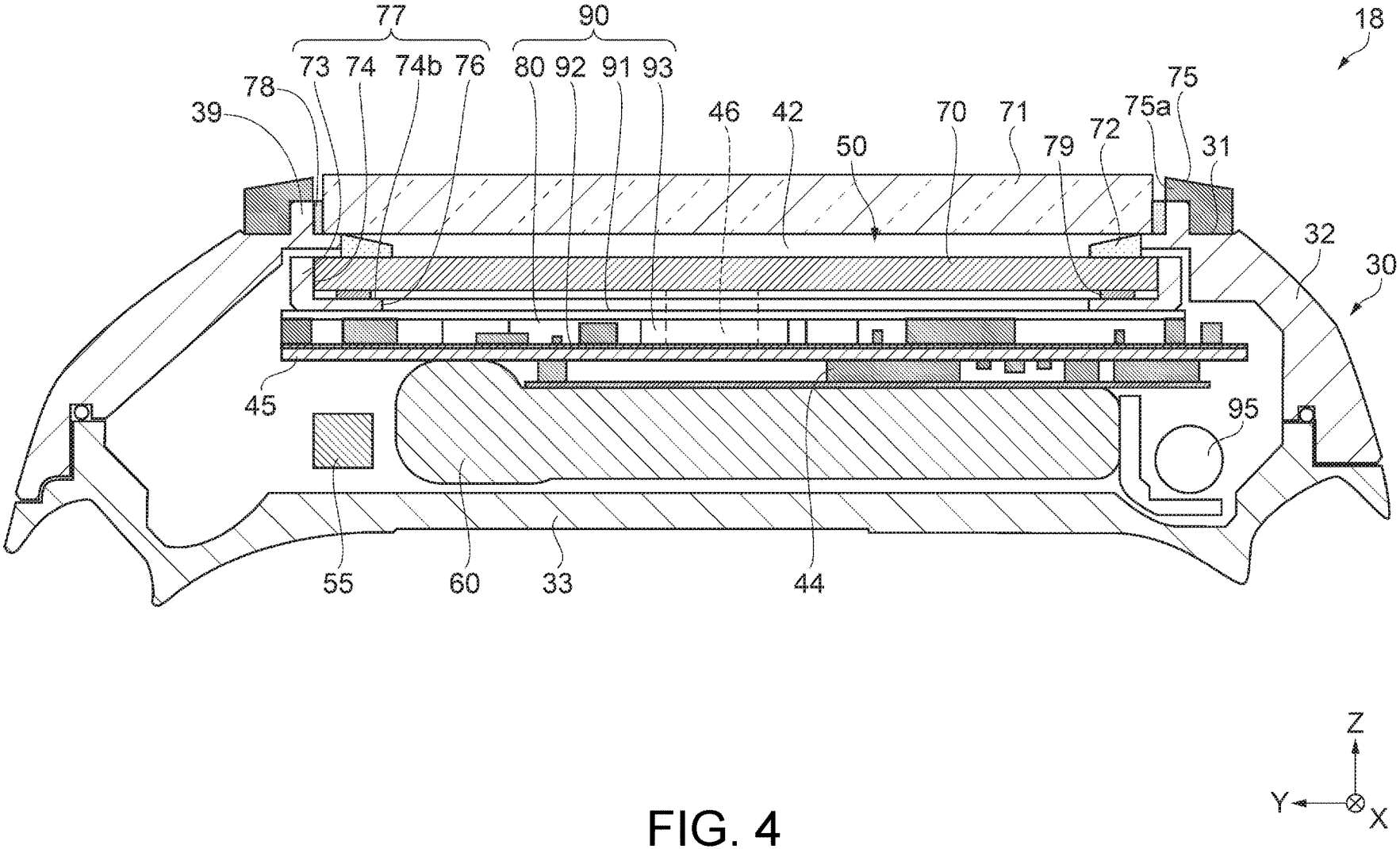
FIG. 4 is a cross-sectional view showing a configuration of the wrist device.
Figure 5:
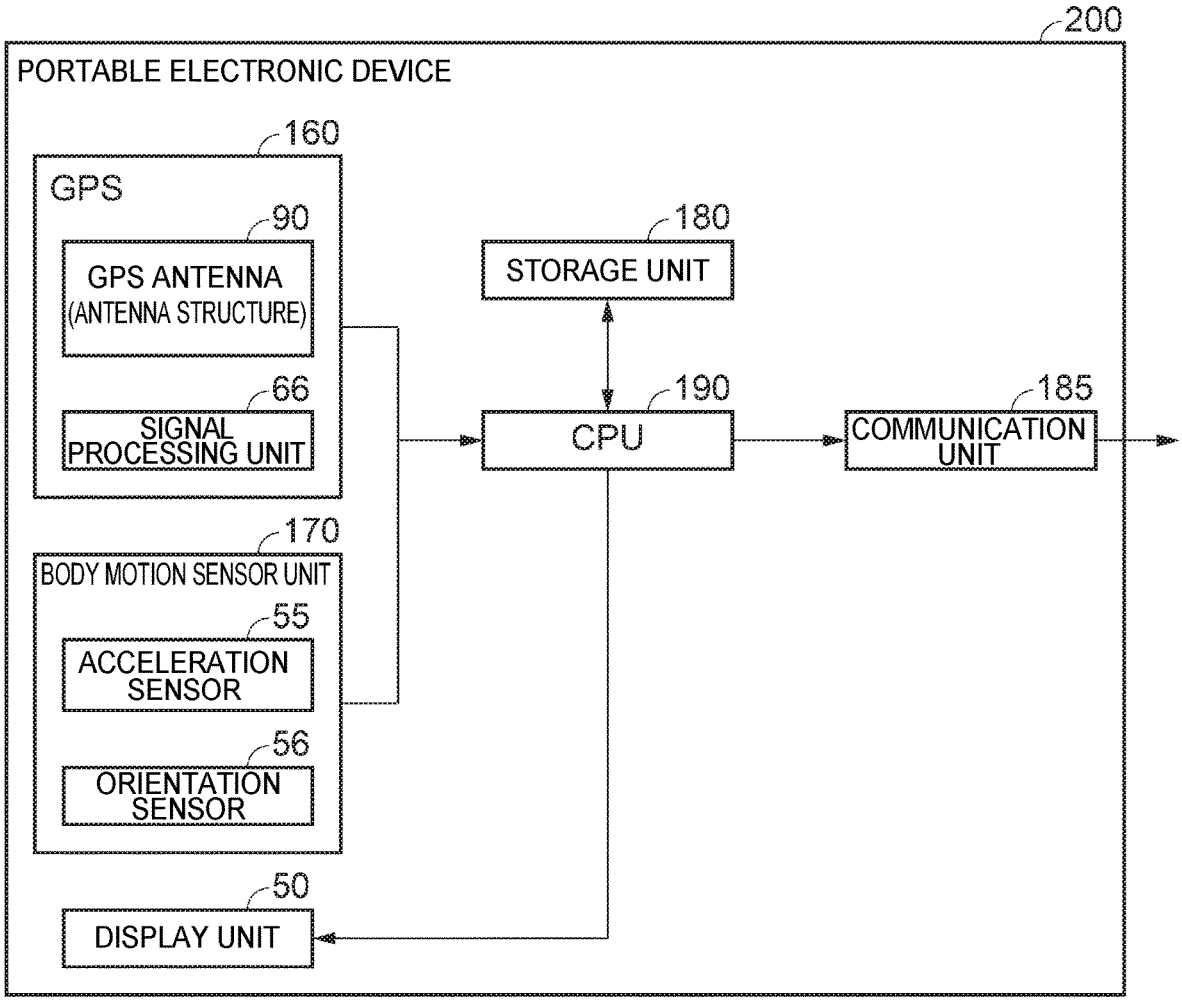
FIG. 5 is a block diagram showing a configuration example of the wrist device.

First, with reference to FIG. 1, FIG. 2, FIG. 3, FIG. 4, and FIG. 5, a description will be given of a configuration example in which a wrist device as an embodiment of the portable electronic device according to the invention is applied to an exercise support system. FIG. 1 is a schematic configuration diagram showing an outline of the exercise support system to which the wrist device as an example of a portable electronic device using the antenna structure according to the invention is applied. FIG. 2 is an external view showing a schematic configuration of the wrist device. FIG. 3 is an external view showing an example of attachment of the wrist device. FIG. 4 is a cross-sectional view showing a configuration of the wrist device. FIG. 5 is a block diagram showing a configuration example of the wrist device.

1. Exercise Support System

As shown in FIG. 1, the exercise support system 100 according to the present embodiment includes a wrist device 200 provided with a GPS (not shown) and a body motion sensor (not shown), a portable device 300, and a server 400 as an information processing apparatus connected with the portable device 300 through a network NE.

The GPS which is the global navigation satellite system included in the wrist device 200 has a function of receiving radio waves (satellite signals) from the GPS satellite 8 to correct the internal time, or acquire position information for performing positioning calculation.

The GPS satellite 8 is an example of a position information satellite circling on a predetermined orbit in the sky above the earth. The GPS satellite 8 transmits radio waves of a high frequency superimposed with a navigation message, for example, radio waves of 1.57542 GHz (L1 wave) to the ground. In the following description, a radio wave of 1.57542 GHz on which a navigation message is superimposed is referred to as a satellite signal. The satellite signal is the circularly polarized wave of the right-handed polarized wave.

Currently, there is a plurality of GPS satellites 8 (only four are shown in FIG. 1). In order to identify from which GPS satellite 8 the satellite signal is transmitted, each GPS satellite 8 superimpose specific patterns of 1023 chips (1 ms period) called a coarse/acquisition code (C/A code) on the satellite signal. In the C/A code, each chip is either +1 or −1, and it looks like a random pattern. Therefore, it is possible to detect the C/A code superimposed on the satellite signal, by correlating the satellite signal with the pattern of each C/A code.

The GPS satellite 8 is provided with an atomic timepiece. The satellite signal includes extremely accurate GPS time information timed by the atomic timepiece. A small time error of the atomic timepiece provided in each GPS satellite 8 is measured by ground control segments. The satellite signal also includes a time correction parameter for correcting the time error. The wrist device 200 can receive satellite signals (radio waves) transmitted from one GPS satellite 8, and acquire time information by using the GPS time information and the time correction parameter contained therein.

The satellite signal also includes orbit information indicating the position on the orbit of the GPS satellite 8. The wrist device 200 can perform positioning calculation using the GPS time information and the orbit information. The positioning calculation is performed on the premise that a certain degree of error is included in the internal time of the wrist device 200. That is, in addition to the x, y, z parameters for specifying the three-dimensional position of the wrist device 200, the time error is also an unknown number. Therefore, the wrist device 200 receives satellite signals (radio waves) respectively transmitted from, for example, three or more GPS satellites 8, and performs positioning calculation using the GPS time information and the orbit information included therein, thereby acquiring the position information of the current position.

The portable device 300 which is an exercise support device can be configured with, for example, a smartphone, a tablet-type terminal device, or the like. The portable device 300 is connected to the wrist device 200 using an acceleration sensor 55 or the like which is a body motion sensor, by short-range wireless communication, wired communication (not shown), or the like, exemplified as BLUETOOTH (registered trademark) communication, or the like.

The portable device 300 can be connected to a server 400 such as a personal computer (PC) or a server system through the network NE. The network NE here can use various networks NE such as a wide area network (WAN), a local area network (LAN), and short-range wireless communication. In this case, the server 400 is realized as a processing storage unit that receives the body motion information and biometric information measured by the wrist device 200 from the portable device 300 through the network NE and stores the information.

Further, the exercise support system 100 is not limited to what is realized by the server 400. For example, the exercise support system 100 may be realized by the portable device 300. For example, the portable device 300 such as a smartphone often has restrictions in processing performance, storage area, and battery capacity as compared with the server system, but in consideration of the recent performance improvement, it can be considered that sufficient processing performance or the like can be secured. Therefore, if the requirements such as processing performance are satisfied, the portable device 300 can be used as an exercise support system 100 according to the present embodiment.

Further, the exercise support system 100 of the present embodiment includes a memory that stores information (for example, programs and various data) and a processor that operates based on the information stored in the memory. With respect to the processor, for example, the functions of the respective parts may be realized by individual hardware, or the functions of respective parts may be realized by integrated hardware. The processor may be, for example, a central processing unit (CPU). However, the processor is not limited to a CPU, and various processors such as a graphics processing unit (GPU) or a digital signal processor (DSP) can be used. The processor may be a hardware circuit based on an ASIC. The memory may be a semiconductor memory such as a static random access memory (SRAM) or a dynamic random access memory (DRAM), a register, a magnetic storage device such as a hard disk device, or an optical storage device such as an optical disk device. For example, the memory stores computer readable instructions, and the processor executes the instructions to realize the function of each part of the exercise support system 100. The instruction here may be an instruction constituting the program or an instruction instructing the hardware circuit of the processor to perform the operation.

2. Wrist Device

As shown in FIG. 3, the wrist device 200 is attached to a given part of the user (for example, a measurement target part such as a wrist), and detects body motion information, position information, and the like. As shown in FIG. 2 and FIG. 3, the wrist device 200 includes a device body 18 including a case portion 30 and attached to the user, and a pair of band parts 10 which is attached to the device body 18 and used for attaching the device body 18 to the user. A display unit 50 which is visible from the front side is provided in the device body 18 including the case portion 30. The band part 10 is provided with a fitting hole 12 and a buckle 14. The buckle 14 includes a buckle frame 15 and a locking portion (protruding rod) 16.

In the following description of the wrist device 200, the "object (object part)" to be measured may be referred to as "subject". Further, a coordinate system is set with the case portion 30 of the wrist device 200 as a reference, and a direction intersecting with the display surface of the display unit 50, from the back surface to the front surface in a case where the display surface side of the display unit 50 is the front surface is defined as the Z-axis positive direction. Alternatively, the direction away from the case portion 30 in the normal direction of the display surface of the display unit 50 may be defined as the Z axis positive direction. In a state where the wrist device 200 is attached to the subject, the Z-axis positive direction corresponds to the direction from the subject to the case portion 30. Two axes perpendicular to the Z axis are defined as X and Y axes, and the direction in which the band part 10 is attached to the case portion 30 is defined as the Y axis.

FIG. 2 is a perspective view showing the wrist device 200 which is in a state where the band part 10 is fixed using the fitting hole 12 and the locking portion 16, as viewed from the −Z-axis direction which is the direction of the band part (the side of the subject in an attached state among the surfaces of the case portion 30). In the wrist device 200, a plurality of fitting holes 12 are provided in the band part 10, and the wrist device 200 is attached to the user by inserting the locking portion 16 of the buckle 14 into one of the plurality of fitting holes 12. The plurality of fitting holes 12 are provided along the longitudinal direction of the band part 10.

The device body 18 includes a case portion 30 including a top case 32 and a bottom case 33 as shown in FIG. 4. The bottom case 33 is located on the side (back side) of the object to be measured when the device body 18 is attached to the user. The top case 32 is disposed on the opposite side (front side) from the object to be measured with respect to the bottom case 33.

FIG. 3 is a view of the wrist device 200 in a state where the wrist device 200 is attached to the user as seen from the side where the display unit 50 is provided (Z-axis direction). As shown in FIG. 3, the wrist device 200 according to the present embodiment includes the display unit 50 at a position corresponding to the dial of a normal wristwatch, or at a position where numbers and icons can be visually recognized. In the attached state of the wrist device 200, the bottom case 33 (see FIG. 4) side of the case portion 30 is brought into close contact with the subject and the display unit 50 is in a position where the user can easily view the display unit 50.

Next, the configuration of the device body 18 of the wrist device 200 will be described with reference to the cross-sectional structure example shown in FIG. 4 and the functional block example shown in FIG. 5. As shown in FIG. 4, the device body 18 has an inner space as an airtight space inside the case surrounded by the top case 32 and the bottom case 33 and the windshield 71 which airtightly closes the opening portion of the top case 32 through the joining member 78. In the inner space, a liquid crystal display (LCD) 70 constituting, for example, the display unit 50 which is an element part constituting the device body 18, a parting plate 72, a frame 77 holding the liquid crystal display 70, a circuit board 45 which is a plate element including the ground conductor portion 92, a GPS antenna 90 which is an antenna structure, an acceleration sensor 55 which is an example of a body motion sensor, a secondary battery 60, and a vibration portion 95, or the like are accommodated. Further, element parts constituting the wrist device 200 and various electronic parts constituting a control circuit that controls the display unit 50 and the like and a driving circuit are connected to the circuit board 45. However, the device body 18 is not limited to the configuration shown in FIG. 4, but it is also possible to add another sensor such as an orientation sensor 56 (see FIG. 5) or a pulse wave sensor (not shown) or electronic parts, or omit some configurations.

The frame 77 includes a wall portion 73 on the outer circumference, opens toward the windshield 71 side, and includes a recessed portion 74 having an inner bottom surface **74*b* inside the wall portion 73. The inner bottom surface 74*b* of the recessed portion 74 is provided with a through hole 76 penetrating the front and back of the central portion of the inner bottom surface 74*b*. The liquid crystal display 70 is attached to the inner bottom surface 74*b* located on the outer circumferential side of the through hole 76 of the recessed portion 74 through a first circumferential seal member 79 in the frame 77. In addition, the frame 77 to which the liquid crystal display 70 is attached can be attached with a second annular seal member (not shown) or the like interposed between the frame 77 and the inner surface of the top case 32. In other words, by attaching the frame 77 to the top case 32, the liquid crystal display 70 is disposed with the first space 42 interposed between the frame 77 and the windshield 71**.

The device body 18 may be configured such that the user can view the display of the display unit 50 and the display of the parting plate 72 through the windshield 71. That is, in the wrist device 200 of the present embodiment, various types of information such as position information, exercise information, or time information are displayed on the display unit 50, and the display is presented to the user from the front side of the device body 18. Note that the windshield 71 located on the top plate portion of the device body 18 is a transparent member through which the display unit 50 (liquid crystal display 70) can be visually recognized, and can be made of, for example, a material such as a transparent glass plate or transparent plastic as long as it is a member having a strength to protect configuration components included in the case portion 30 such as the liquid crystal display 70.

A frame 77 for guiding the liquid crystal display 70 is disposed on one surface of the circuit board 45 which is a plate element, and a circuit case 44 for guiding the secondary battery 60 or the like is disposed on the other surface. The connection portion between the circuit board 45 and the frame 77 is omitted for convenience of illustration. On the circuit board 45, electronic parts E1 and E2 (see FIG. 6) such as a CPU 190 (see FIG. 5) as a control circuit for controlling a circuit for controlling the GPS 160 (see FIG. 5) including the GPS antenna 90, a circuit for driving sensors such as the acceleration sensor 55 and detecting body motion information, a circuit for driving the liquid crystal display 70, or the like are mounted. The circuit board 45 is electrically connected to the electrode of the liquid crystal display 70 through a connector (not shown).

A so-called printed circuit board can be applied to the circuit board 45. As the circuit board 45, for example, paper phenolic substrate paper impregnated with phenolic resin, or a circuit (pattern) wiring made of a conductive material such as copper foil on a glass epoxy substrate impregnated with epoxy resin on a base on which cloths made of glass fiber are laminated, a flexible wiring substrate on which a wiring pattern of a thin copper foil is formed on a base made of a film such as a thin polyimide or polyester and which is covered with an insulating film or the like for protecting the surface, or the like can be applied.

On one surface of the circuit board 45, a ground conductor portion 92 is disposed as a member constituting the GPS antenna 90 which is an antenna structure. The ground conductor portion 92 is constituted by a grounding pattern (GND layer) included in the wiring pattern disposed on one surface of the circuit board 45. Then, the grounding pattern (GND layer) is electrically connected with the antenna electrode 91 by a short circuit unit 93 (short circuit element) which is derived from the outer edge portion of the antenna electrode 91 which is a plate conductor element disposed with the skeletal resin frame 80 for frequency adjustment constituting the GPS antenna 90 interposed therebetween. The GPS antenna 90 which is the antenna structure will be described in detail later.

In this way, if the circuit board 45 is applied as the plate element, since the ground conductor portion 92 is formed on the circuit board 45, the space efficiency can be further improved, and a small antenna structure (GPS antenna 90) can be obtained.

A rechargeable secondary battery 60 (lithium secondary battery) is guided in the circuit case 44. The secondary battery 60 has terminals of both poles connected to the circuit board 45 by a connecting board (not shown) or the like, and supplies power to a circuit that controls the power. The power is supplied to each circuit by being converted into a predetermined voltage by this circuit, and operates each circuit and a control circuit (CPU 190) that controls each circuit. The secondary battery 60 is charged through a pair of charging terminals electrically connected to the circuit board 45 by a conductive member (not shown) such as a coil spring. Although an example in which the secondary battery 60 is used as a battery is described here, a primary battery that does not need to be charged may be used as the battery.

For example, position information or a movement amount using the GPS 160 (see FIG. 5) and the orientation sensor 56, exercise information such as an exercise amount using an angular velocity sensor (not shown) or the acceleration sensor 55, time information such as current time, or the like are displayed on the liquid crystal display (LCD) 70 constituting the display unit 50, depending on various detection modes. This display can be visually recognized by the user through the windshield 71. The display unit 50 is electrically connected to the circuit board 45 by the flexible connection board 46 passing through the through hole 76 of the frame 77, or the like, and the display content is controlled.

It is preferable that the liquid crystal display 70 constituting the display unit 50 is disposed so as to overlap the antenna electrode 91 of the antenna structure (GPS antenna 90) including the circuit board 45 in plan view. In this manner, since the display unit 50 is disposed so as to overlap the antenna structure (GPS antenna 90), electrical shielding for reducing radio waves absorption by the display unit 50 can be performed without reducing the shielding effect. In order to further enhance the shielding effect, it is preferable that a flexible connection board 46 electrically connecting the display unit 50 and the circuit board 45 is positioned on the outer edge side of the device body 18, and when viewed from the outer edge side (X-axis direction) of the device body 18, the outer edge of the short circuit unit 93 is located outside the outer edge of the flexible connection board 46 such that a short circuit unit 93 (see FIG. 6) derived from the antenna electrode 91 overlaps the flexible connection board 46, or the flexible connection board 46 is included in the short circuit unit 93.

In the above description, an example in which the display unit 50 is configured with the liquid crystal display (LCD) 70 is described, but the invention is not limited thereto. As the display unit 50, any one of the liquid crystal display (LCD) 70, an organic electroluminescence (EL) display, and an electrophoretic display (EPD) can be applied. A small wrist device 200 realizing clearer display can be realized also as the display unit 50 using such a display.

Further, it is preferable that at least a part of the outer edge region of the antenna electrode 91 (antenna structure) protrudes beyond the liquid crystal display 70 constituting the display unit 50 in plan view from the Z-axis direction. In this way, the liquid crystal display 70 and the antenna electrode 91 (antenna structure) overlap with each other more reliably, so that the shielding effect can be exerted more reliably.

On the front side (the windshield 71 side) of the display unit 50, a parting plate 72 is placed along the inner periphery of the protrusion portion 39 protruding to the inside of the top case 32. In other words, the parting plate 72 is located between the windshield 71 and the display unit 50, and is disposed along the outer edge of the display unit 50. The parting plate 72 can be made of a material obtained by applying a plating treatment on the surface of a stainless steel material, an aluminum material, or a brass material, for example. As the parting plate 72, for example, a resin material mainly made of epoxy resin, or an elastic member functioning as a cushioning material or a packing (sealing material) can be used.

The device body 18 is located on the outer edge side of the top case 32 and has a peripheral recessed portion 31 opening toward the front side. A protrusion portion 39 is erected on the inner peripheral side of the recessed portion 31. At least a part of a bezel 75 is inserted and fixed to the recessed portion 31. In this way, by inserting the bezel 75 in the recessed portion 31, it is possible to easily align the bezel 75 with respect to the top case 32.

The bezel 75 has an eaves portion 75*a* protruding toward the windshield 71 side. The eaves portion 75*a* may be brought into contact with the top of the protrusion portion 39 on the inner peripheral side of the top case 32. Deformation of the eaves portion 75*a* can be reduced by bringing the eaves portion 75*a* into contact with the top portion of the protrusion portion 39 of the top case 32. The bezel 75 can be made of a material obtained by applying a plating treatment on the surface of a stainless steel material or a brass material, for example.

The windshield 71 is disposed so as to be aligned with the inner peripheral surface of protrusion portion 39 on the inner peripheral surface (inner surface) side of protrusion portion 39 provided in the top case 32. The windshield 71 is connected to the inner peripheral surface of the protrusion portion 39 through a joining member 78. The windshield 71 is held by the joining member 78 so as not to drop out from the device body 18 (top case 32). The present embodiment is configured such that a gap is provided between the inner surface of the eaves portion 75*a* of the bezel 75 and the windshield 71, but it may be configured such that the inner surface of the eaves portion 75*a* of the bezel 75 is brought into contact with the outer peripheral surface of the windshield 71.

Next, the functional configuration of the wrist device 200 will be described with reference to FIG. 5. As shown in FIG. 5, the wrist device 200 includes a display unit 50, a GPS 160, a body motion sensor unit 170, a storage unit 180, a communication unit 185, and a CPU 190, as functional configuration components.

The GPS 160 includes a GPS antenna 90 which is an antenna structure, and a signal processing unit 66, and the signal processing unit 66 performs positioning calculation based on the plurality of satellite signals received by the GPS antenna 90 and can acquire the position as user's position information.

The body motion sensor unit 170 includes an acceleration sensor 55, an orientation sensor (geomagnetic sensor) 56, or the like, and is capable of detecting information on the movement of the user's body, that is, detecting body motion information. The body motion sensor unit 170 outputs a body motion detection signal which is a signal that changes according to the body motion of the user.

Under the control of the CPU 190, the storage unit 180 stores position information by the GPS 160, body motion information by the body motion sensor unit 170, or the like.

The CPU 190 constitutes control circuits such as a circuit for driving the display unit 50 (liquid crystal display 70), a circuit for driving the body motion sensor unit 170 and detecting body motion information, and a circuit for controlling the GPS 160. The CPU 190 transmits the time information and body motion information detected at each part, or the position information of the user, to the communication unit 185. Then, the communication unit 185 transmits the time information and body motion information, or the position information of the user, transmitted from the CPU 190, to the portable device 300 (see FIG. 1).

3. Antenna Structure (GPS Antenna 90)

Figure 6:
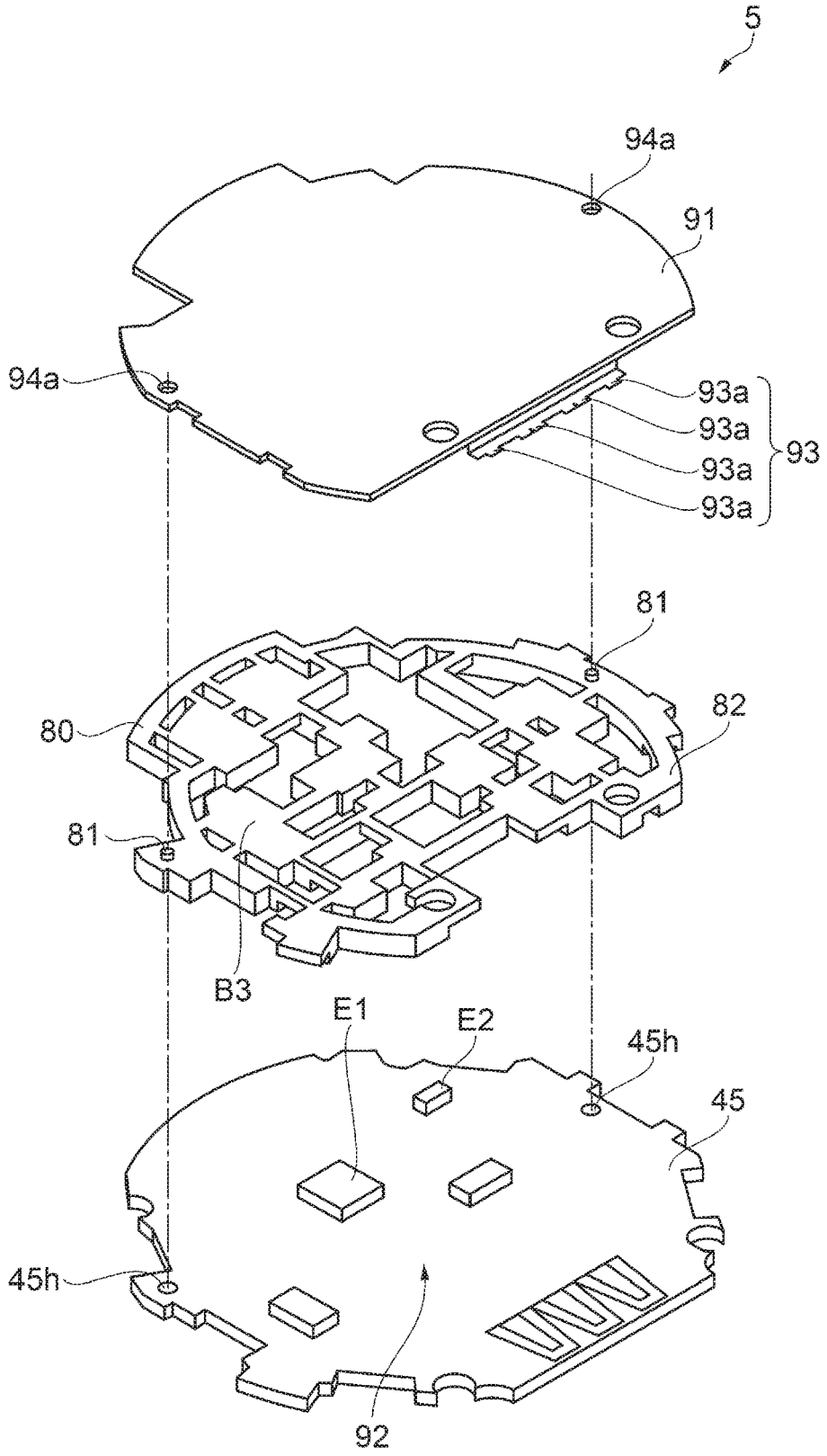
FIG. 6 is an exploded perspective view showing a schematic configuration of the antenna structure.
Figure 7:
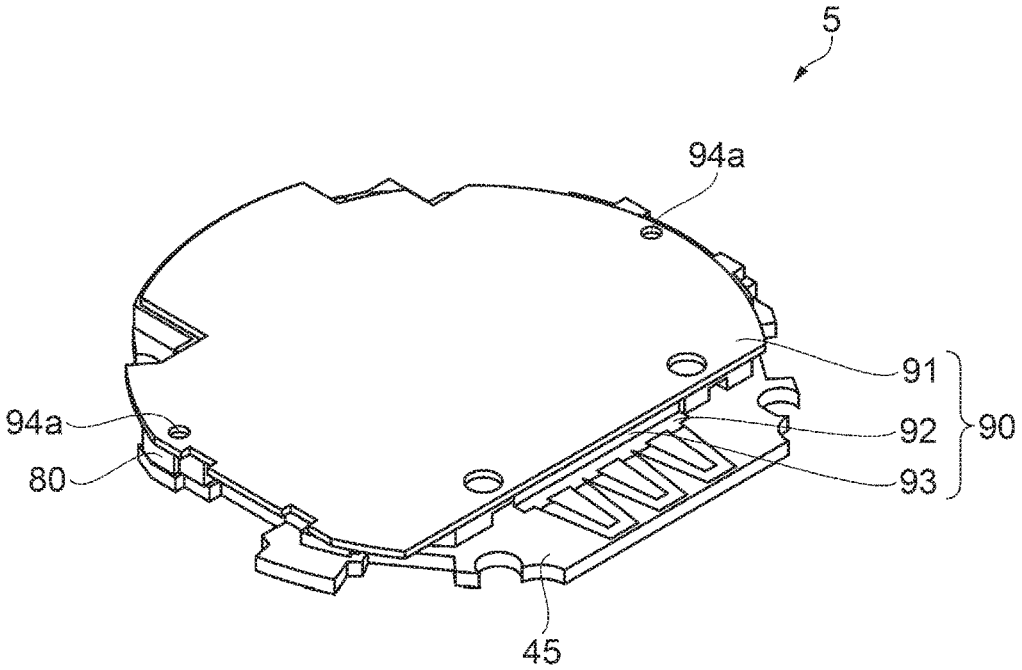
FIG. 7 is a perspective view showing the schematic configuration of the antenna structure.
Figure 8:
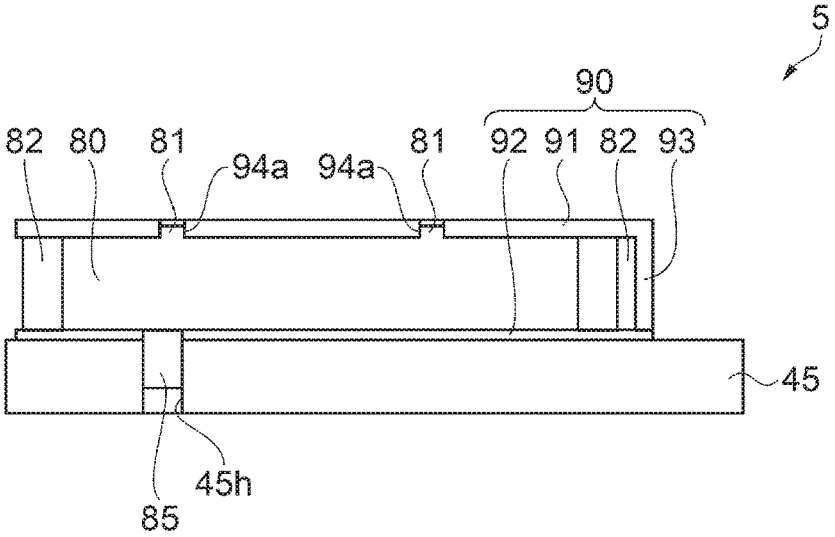
FIG. 8 is a cross-sectional view showing the schematic configuration of the antenna structure.
Figure 9:
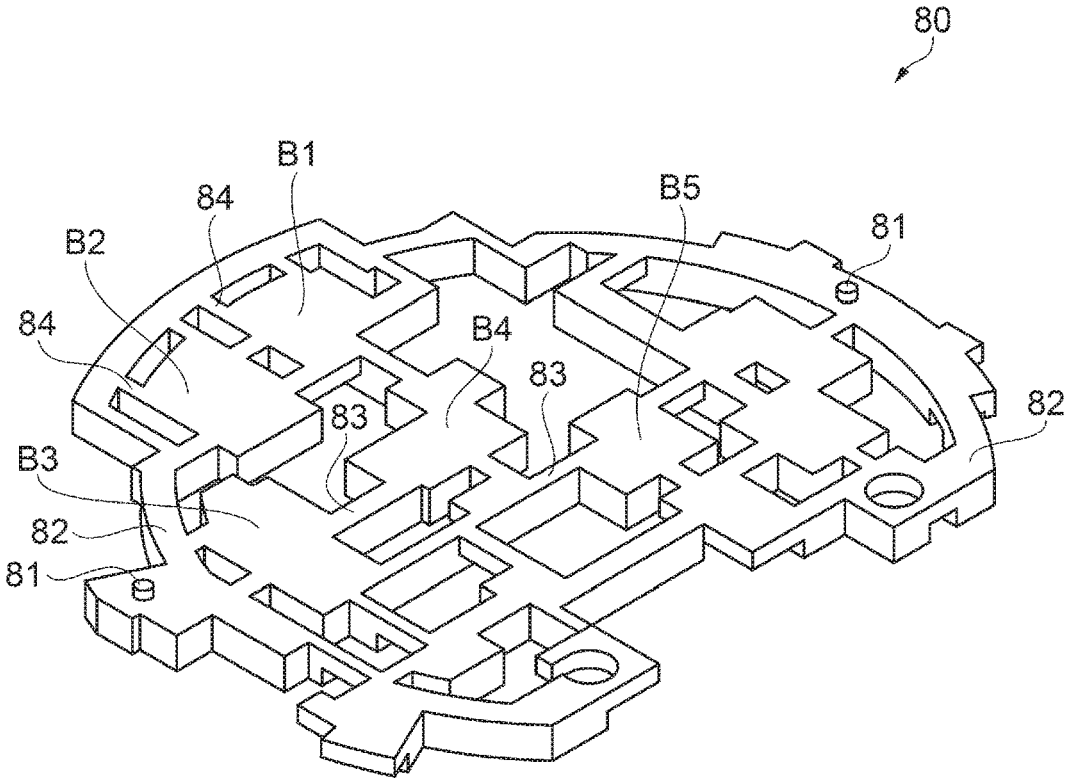
FIG. 9 is a perspective view showing a schematic configuration of a resin frame constituting the antenna structure.

Here, the detailed configuration of the GPS antenna 90 will now be described with reference also to FIGS. 6, 7, 8, and 9. FIG. 6 is an exploded perspective view showing a schematic configuration of the antenna structure. FIG. 7 is perspective view showing the schematic configuration of the antenna structure. FIG. 8 is a cross-sectional view showing the schematic configuration of the antenna structure. FIG. 9 is a perspective view showing a schematic configuration of a resin frame constituting the antenna structure.

The GPS antenna 90 which is an antenna structure is an antenna to which a plate inverted F antenna or a planar inverted F antenna (PIFA) is applied. The GPS antenna 90 has a structure in which the antenna electrode 91 which is the plate conductor element and the circuit board 45 which is the plate element including the ground conductor portion 92 are disposed to be opposed to each other, the antenna electrode 91 and the ground conductor portion 92 are short-circuited using the short circuit unit 93, and electric power is supplied to the antenna electrode 91 by a feeding element (not shown) to obtain radio wave radiation. In addition, the GPS antenna 90 includes a resin frame 80 for frequency adjustment disposed between the antenna electrode 91 and the circuit board 45. The resin frame 80 has an effect of maintaining the parallelism between the ground conductor portion 92 and the antenna electrode 91 by disposing the resin frame 80 between the circuit board 45 and the antenna electrode 91, and it also contributes to the electrical performance of the GPS antenna 90.

More specifically, the GPS antenna 90 includes the circuit board 45 which is a plate element having a grounding pattern (GND layer) disposed on one surface of the circuit board 45 as the ground conductor portion 92, the antenna electrode 91 made of a metal plate having a thickness of about 0.1 mm as a plate conductor element disposed so as to overlap the circuit board 45, in plan view from the Z direction, and the skeletal resin frame 80 for frequency adjustment which is disposed between the antenna electrode 91 and the circuit board 45. The antenna electrode 91 and the grounding pattern (GND layer) constituting the ground conductor portion 92 disposed on one surface of the circuit board 45 are electrically connected by a short circuit unit 93 derived from the outer edge portion of the antenna electrode 91.

The short circuit unit 93 of the present embodiment has a configuration in which a part of the outer edge portion of the antenna electrode 91 is extended and bent, and, as shown in FIG. 6, a plurality of connection portions 93*a* are provided (in the present embodiment, four connection portions 93*a* are illustrated). In this way, since the short circuit unit 93 connecting the antenna electrode 91 and the grounding pattern (GND layer) constituting the ground conductor portion 92 disposed on one surface of the circuit board 45 is configured with the plurality of connection portions 93*a*, the antenna electrode 91 and the grounding pattern (GND layer) can be more reliably short-circuited.

The plurality of connection portions 93*a* constituting the short circuit unit 93 are not limited to the above-mentioned plate members, and the same effect as the plate member can be obtained, for example, by short-circuiting the antenna electrode 91 and the grounding pattern (GND layer) in a plurality of places such as a plurality of pin members or a plurality of coil springs.

As shown in FIG. 9, a skeletal resin frame 80 for frequency adjustment is configured to include a plurality of blocks. In the present embodiment, a description will be made showing five blocks B1, B2, B3, B4, and B5 as the plurality of blocks. The blocks B1, B2, B3, B4, and B5 are connected to each other by a connecting beam 83 which is a beam, and connected to the outer peripheral frame portion 82 by the connection beam 84. The resin frame 80 is formed into a skeleton shape by such blocks B1, B2, B3, B4, and B5, the connecting beam 83, the connection beam 84, and the like. In the present embodiment, five blocks B1, B2, B3, B4, and B5 of different shapes are shown as the plurality of blocks, but their shapes and numbers are not limited.

In the outer peripheral frame portion 82 of the resin frame 80, two protrusion portions 81 are provided on the front surface side, and two protrusion portions 85 (see FIG. 8, one of them is not illustrated in FIG. 8) are provided on the back surface side. Since the protrusion portion 81 on the front side is inserted into a guide hole 94*a* provided in the antenna electrode 91 and the protrusion portion 85 on the back side is inserted into a guide hole 45*h* provided in the circuit board 45, the resin frame 80, the antenna electrode 91 and the circuit board 45 are aligned and connected to each other.

In the resin frame 80, one of the plurality of blocks including the blocks B1, B2, B3, B4, and B5 is cut off by cutting a part of the connecting beam 83 and the connection beam 84 as necessary, so that the resonance frequency of the GPS antenna 90 (antenna electrode 91) can be varied. As described above, the frequency can be adjusted such that the resonance frequency of the GPS antenna 90 (antenna electrode 91) is included within a predetermined frequency range, by cutting off one of the blocks B1, B2, B3, B4, and B5 of the resin frame 80 as necessary. Further, one of the blocks B1, B2, B3, B4, B5 can easily be cut-off in a simple manner, by cutting a part of the connecting beam 83 and the connection beam 84 where the respective blocks B1, B2, B3, B4, and B5 are connected to each other.

In the GPS antenna 90 (antenna electrode 91) having such a configuration, the dissipation factor (tan δ) of the resin material constituting the resin frame 80 for frequency adjustment disposed between the antenna electrode 91 and the circuit board 45 is preferably within the range of more than 0 (zero) and 0.001 or less. This will be described below.

Figure 10:
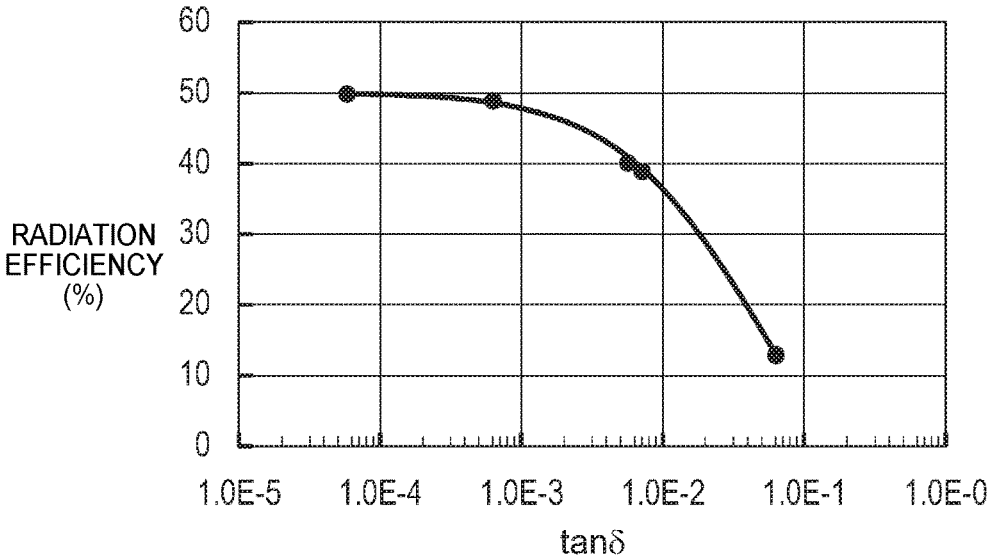
FIG. 10 is a graph showing a relationship between a dissipation factor (tan δ) of the resin frame and a radiation efficiency of the antenna structure.

The graph shown in FIG. 10 represents a relationship between a dissipation factor (tan δ) of the resin frame 80 and a radiation efficiency of the antenna structure (GPS antenna 90). According to FIG. 10, it is understood that if the dissipation factor (tan δ) is over 0.001, radio waves are absorbed in the resin frame 80 which is the dielectric body, the antenna sensitivity deteriorates, and the radiation efficiency of the antenna structure (GPS antenna 90) sharply decreases. In addition, it is understood that if the dissipation factor (tan δ) is 0.001 or less, the radiation efficiency of the antenna structure (GPS antenna 90) is stable with almost no change in the state of high radiation efficiency. As a resin having such a dissipation factor (tan δ), for example, cyclic olefin-based copolymer (COC) or the like can be used. In addition, the dissipation factor (tan δ) of the cyclic olefin-based copolymer (COC) is about 0.0006. Thus, by setting the dissipation factor (tan δ) of the resin frame 80 to a range of 0.001 or less and over 0 (zero), it is possible to realize an antenna structure (GPS antenna 90) capable of maintaining a state of high radiation efficiency of the antenna structure (GPS antenna 90), that is, good reception sensitivity.

In the antenna structure (GPS antenna 90) as described above, the blocks B1, B2, B3, B4, and B5 of the resin frame 80 are cut off and used as a frequency adjustment unit having a function of varying the resonance frequency. Therefore, since the antenna electrode 91 itself which is a conductor element functioning as a radiating plate for frequency adjustment is not cut out, the antenna structure (GPS antenna 90) which maintains good reception sensitivity without impairing electric power for radio waves can be realized.

4. Frequency Adjustment Method of Antenna Structure (GPS Antenna 90)

Figure 11:
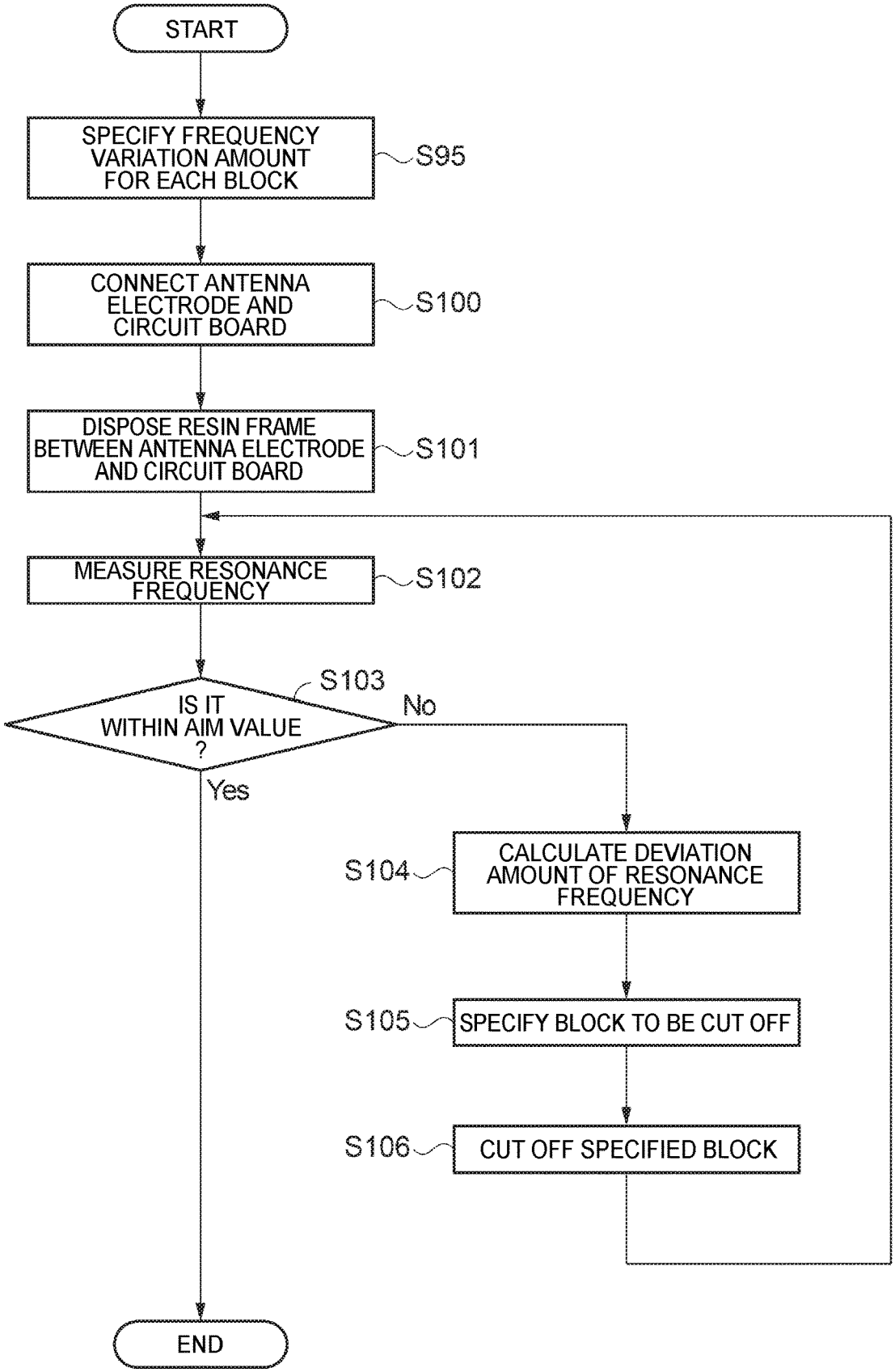
FIG. 11 is a flowchart showing a procedure of a frequency adjustment method of the antenna structure.
Figure 12:
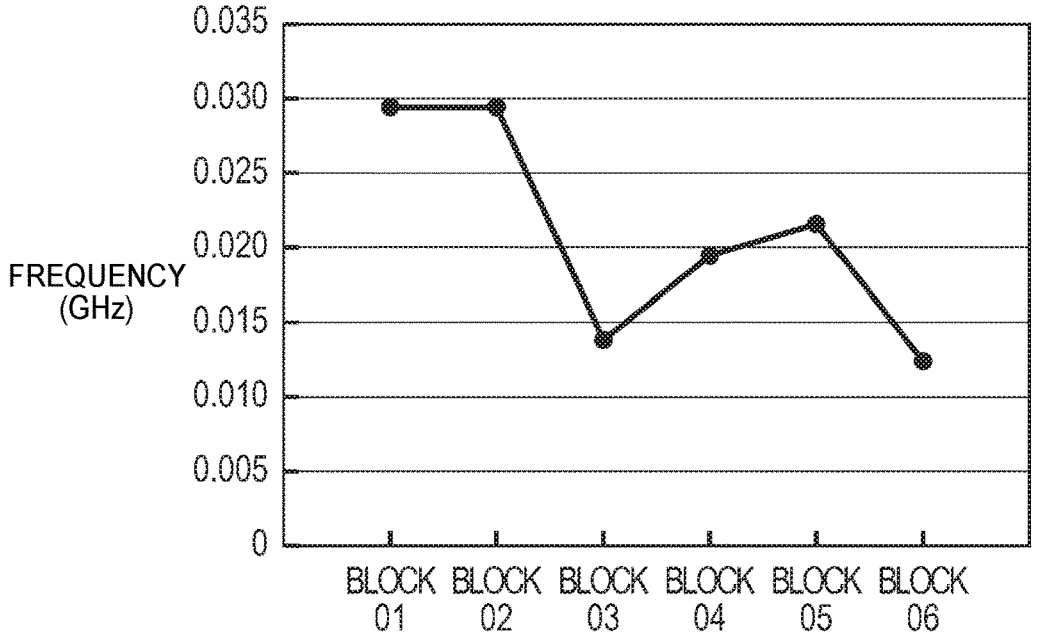
FIG. 12 is a graph showing a frequency variation amount by each block constituting the resin frame.

Next, the frequency adjustment method of the antenna structure (GPS antenna 90) will be described with reference to FIGS. 11 and 12. FIG. 11 is a flowchart showing a procedure of a frequency adjustment method of the antenna structure. FIG. 12 is a graph showing a frequency variation amount by each block constituting the resin frame.

The frequency adjustment method of the antenna structure (GPS antenna 90) includes specifying the variation amount of the resonance frequency of the GPS antenna 90 in a case of cutting off a block to be cut off among the blocks B1, B2, B3, B4, and B5, for each of the plurality of blocks B1, B2, B3, B4, and B5 of the resin frame 80, as a preparation step (step S95). Furthermore, the frequency adjustment method of the antenna structure (GPS antenna 90), in other words, the frequency adjustment method of the antenna electrode 91 which is a conductor element includes the following steps.

(1) Connecting the antenna electrode 91 which is a conductor element and the ground conductor portion 92 disposed on the circuit board 45 which is a plate element by a short circuit unit 93 (step S101).

(2) Placing the resin frame 80 between the antenna electrode 91 and the circuit board 45 (step S102).

(3) Measuring the resonance frequency of the GPS antenna 90 (antenna electrode 91) (step S102).

(4) Determining whether or not the measured resonance frequency is within a specified frequency range (aim value) (step S103).

(5) Calculating a difference (deviation amount) between the measured resonance frequency and the aim value of the specified frequency, in a case where the measured resonance frequency is not within the specified frequency range (aim value) (step S104), and specifying which of the plurality of blocks B1, B2, B3, B4, and B5 constituting the resin frame 80 is to be cut off based on the difference (deviation amount) from the calculated aim value (step S105).

(6) Adjusting the frequency such that the resonance frequency of the GPS antenna 90 (antenna electrode 91) is included within the predetermined frequency range by cutting off the specified block to be cut off out of the plurality of blocks B1, B2, B3, B4, and B5 (step S106).

Hereinafter, each step (procedure) will be described step by step along the flowchart of FIG. 11. Note that the description of the following steps will be given by applying the same reference numerals as used for the explanation of the configuration of the antenna structure (GPS antenna 90).

First, as a preparation step, the variation amount of the resonance frequency of the GPS antenna 90 (antenna electrode 91) in a case of cutting off each of the blocks B1, B2, B3, B4, and B5 is measured and specified, for each of the plurality of blocks B1, B2, B3, B4, and B5 of the resin frame 80 (step S95). The frequency variation amount of each of the blocks B1, B2, B3, B4, and B5 differs depending on its shape and mass as shown in FIG. 12. With respect to the blocks B1, B2, B3, B4, and B5 formed of the same material, as long as there is no significant change in thickness or shape, the frequency variation amount in each of the blocks B1, B2, B3, B4, and B5 has a small variation, and can previously be set as the frequency variation amount.

Next, the antenna electrode 91 which is a conductor element and the ground conductor portion 92 disposed on one surface of the circuit board 45 which is a plate element are electrically connected by the short circuit unit 93 configured with the plurality of connection portions 93*a* (step S100).

Next, a resin frame 80 for frequency adjustment including the plurality of blocks B1, B2, B3, B4, and B5 is disposed between the antenna electrode 91 and the circuit board (step S101). Then, the resonance frequency of the GPS antenna 90 (antenna electrode 91) is measured (step S102), and it is determined whether the measured resonance frequency is within a predetermined frequency range (aim value) which is necessary as the resonance frequency of the GPS antenna 90 (antenna electrode 91) (step S103).

In a case where it is determined that the measured resonance frequency is within the predetermined frequency range (aim value) (step S103: Yes) in the aforementioned step S103, the frequency adjustment is unnecessary, and the procedure is terminated. Further, in a case where the measured resonance frequency is not within the predetermined frequency range (aim value) (step S103: No) in step S103, the difference between the measured resonance frequency and the aim value at the predetermined frequency (deviation amount) is calculated (step S104).

Then, based on the difference (deviation amount) from the calculated aim value, which one of the blocks B1, B2, B3, B4, and B5 is to be cut off in order to adjust the frequency to be within the prescribed frequency range (aim value) of the GPS antenna 90 (antenna electrode 91) is specified (step S105).

Next, the specified block to be cut off among the plurality of blocks B1, B2, B3, B4, and B5 is cut off, and the frequency is adjusted such that the resonance frequency of the GPS antenna 90 (antenna electrode 91) is included within the predetermined frequency range (step S106).

Thereafter, the process returns to step S102, the resonance frequency of the GPS antenna 90 (antenna electrode 91) is measured, and until it is determined that the measured resonance frequency is within the predetermined frequency range (step S103: Yes), the process proceeds to procedure of step S103: No, and the aforementioned procedural steps S103 to S106 are repeated. That is, in a case where it is determined that the measured resonance frequency is included within the predetermined frequency range (step S103: Yes), a series of procedures are terminated.

According to the above procedure (step), it is possible to perform so-called frequency adjustment in which the resonance frequency of the GPS antenna 90 (antenna electrode 91) is to be within the predetermined frequency range.

According to the frequency adjustment method of the GPS antenna 90 (antenna electrode 91) which is the antenna structure, the resonance frequency is adjusted by cutting off one of the plurality of blocks B1, B2, B3, B4, and B5 of the resin frame 80, based on the measured resonance frequency of the GPS antenna 90 (antenna electrode 91). Therefore, since the antenna electrode 91 itself functioning as a radiating plate is not cutout in order to adjust the resonance frequency, the GPS antenna 90 (antenna electrode 91) which maintains good reception sensitivity without impairing electric power for radio waves can be realized.

Further, since a block to be cut off is specified by comparing the frequency adjustment amount which is the difference between the target resonance frequency of the GPS antenna 90 and the measured resonance frequency with the pre-set frequency variation amount of each of the plurality of blocks B1, B2, B3, B4, and B5 of the resin frame 80, it is possible to cut off the corresponding block simply and easily.

In addition, since the wrist device 200 which is a portable electronic device including the antenna structure (GPS antenna 90) as described above includes the GPS antenna 90 that maintains good reception sensitivity without impairing electric power for radio waves, by using the resin frame 80 as a frequency adjustment unit, it is possible to realize a wrist device which is small in size and stable in reception performance.

5. Modification Example of Antenna Structure (GPS Antenna 90)

The antenna structure (GPS antenna 90) can be applied to other configurations, instead of the configuration of the above-described embodiment. Hereinafter, various modification examples of the antenna structure (GPS antenna 90) will be described.

Modification Example 1

Figure 13:
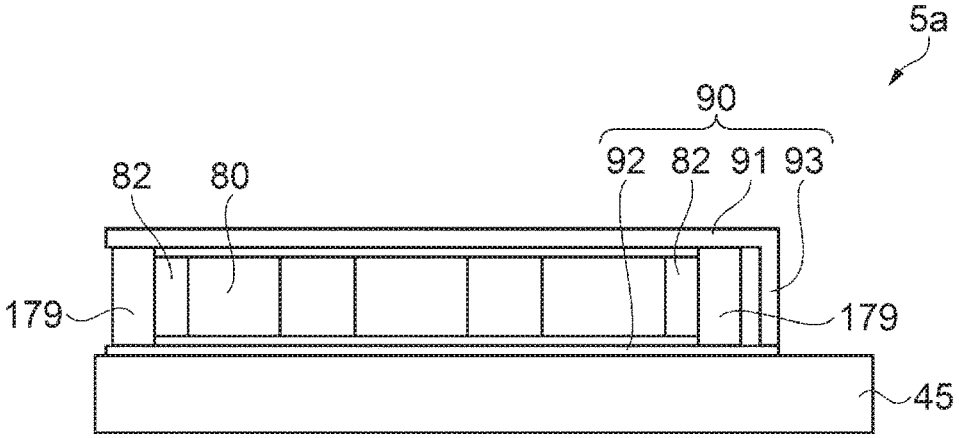
FIG. 13 is a cross-sectional view showing a schematic configuration according to Modification Example 1 of the antenna structure.

First, with reference to FIG. 13, an outline of Modification Example 1 of the antenna structure (GPS antenna 90) according to the invention will be described. FIG. 13 shows the schematic configuration according to Modification Example of the antenna structure (GPS antenna 90), and is a cross-sectional diagram at the same sectional position as in FIG. 6 described above. In the following description relating to Modification Example 1 of the antenna structure (GPS antenna 90), the description is focused on the form and configuration which are different from the above-described embodiment, and the same forms and configurations are denoted by the same reference numerals and the explanation thereof may be omitted.

As shown in FIG. 13, similar to the aforementioned embodiment, the antenna structure (GPS antenna 90) according to Modification Example 1 has a structure in which the antenna electrode 91 and the circuit board 45 including the ground conductor portion 92 are disposed to be opposed to each other, the antenna electrode 91 and the ground conductor portion 92 are short-circuited using the short circuit unit 93, and electric power is supplied to the antenna electrode 91 by a feeding element (not shown) to obtain radio wave radiation. In addition, the GPS antenna 90 includes a resin frame 80 for frequency adjustment disposed between the antenna electrode 91 and the circuit board 45. The configurations of the antenna electrode 91, the circuit board 45 including the ground conductor portion 92, and the resin frame 80 are the same as those in the aforementioned embodiment, so the description thereof will be omitted.

In addition, the antenna electrode 91 and the circuit board 45 are connected with a predetermined interval by a support frame 179 which is a circumferential spacer provided on the outer edge portion thereof. A resin frame 80 for frequency adjustment is disposed in the gap. At this time, the resin frame 80 may be connected to the inside of the support frame 179, or may be formed integrally with the support frame 179.

Even in the antenna structure (GPS antenna 90) according to the Modification Example 1, by using the resin frame 80 as a frequency adjustment unit, good reception sensitivity can be maintained without impairing electric power for radio waves.

Modification Example 2

Figure 14A:
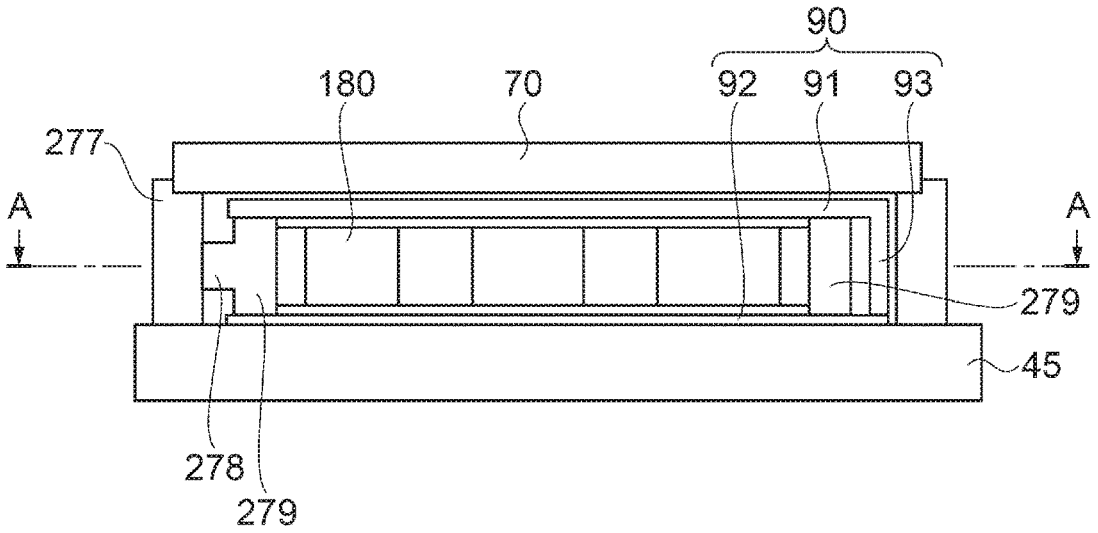
FIG. 14A is a cross-sectional view showing a schematic configuration according to Modification Example 2 of the antenna structure.
Figure 14B:
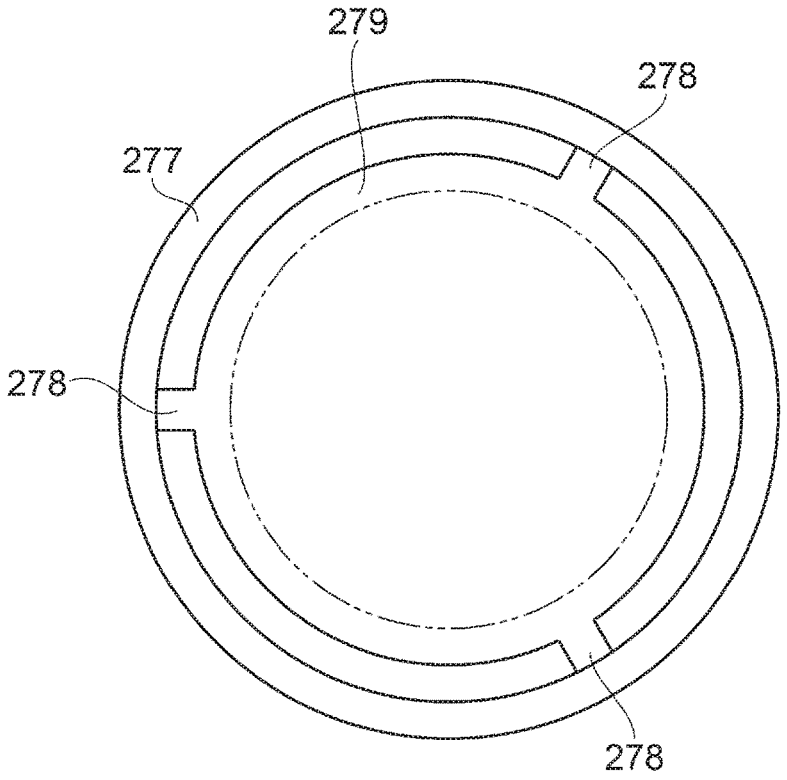
FIG. 14B shows the schematic configuration of Modification Example 2 of the antenna structure, and is a cross-sectional diagram along line A-A in FIG. 14A.

Next, with reference to FIG. 14A and FIG. 14B, an outline of Modification Example 2 of an antenna structure (GPS antenna 90) according to the invention will be described. FIG. 14A is a cross-sectional view showing a schematic configuration according to Modification Example 2 of the antenna structure (GPS antenna 90). FIG. 14B shows the schematic configuration of Modification Example 2 of the antenna structure (GPS antenna 90), and is a cross-sectional diagram along line A-A in FIG. 14A. In the following description relating to Modification Example 2 of the antenna structure (GPS antenna 90), the description is focused on the form and configuration which are different from the above-described embodiment, and the same forms and configurations are denoted by the same reference numerals and the explanation thereof may be omitted.

As shown in FIG. 14A and FIG. 14B, similar to the aforementioned embodiment, the antenna structure (GPS antenna 90) according to Modification Example 2 has a structure in which the antenna electrode 91 and the circuit board 45 including the ground conductor portion 92 are disposed to be opposed to each other, the antenna electrode 91 and the ground conductor portion 92 are short-circuited using the short circuit unit 93, and electric power is supplied to the antenna electrode 91 by a feeding element (not shown) to obtain radio wave radiation. In addition, the GPS antenna 90 includes a resin frame 180 for frequency adjustment disposed between the antenna electrode 91 and the circuit board 45. The configurations of the antenna electrode 91 and the circuit board 45 including the ground conductor portion 92 are the same as those in the aforementioned embodiment, so the description thereof will be omitted. In addition, the configurations other than the support frame 279 of the resin frame 180 are the same as those in the aforementioned embodiment, so the description thereof will be omitted.

In addition, the antenna electrode 91 and the circuit board 45 are connected with a predetermined interval by a support frame 279 which is a circumferential spacer provided on the outer edge portion thereof. A resin frame 180 for frequency adjustment is disposed in the gap. Here, the resin frame 180 may be connected to the inside of the support frame 279, or may be formed integrally with the support frame 279.

The antenna structure (GPS antenna 90) according to Modification Example 2 includes a holding frame 277 for guiding the outer periphery of the liquid crystal display 70 and holding the outer periphery of the liquid crystal display 70. The support frame 279 is connected to the holding frame 277 through a connection portion 278. That is, in the configuration of Modification Example 2, the antenna structure (GPS antenna 90) is connected to the holding frame 277 through the support frame 279 and the connection portion 278.

In this modification example, an example in which the connection portions 278 are disposed in three places is illustrated, but the number of connection portions 278 is not limited. Further, the support frame 279 may be connected to the holding frame 277 by, for example, a fixing bolt, an adhesive, or the like, or the support frame 279 and the holding frame 277 may be connected by being integrally formed. In a case where the support frame 279 and the holding frame 277 are integrally formed, the support frame 279, the holding frame 277, and the resin frame 180 may be integrated into an integral structure.

Even in the antenna structure (GPS antenna 90) according to the Modification Example 2, by using the resin frame 180 as a frequency adjustment unit, good reception sensitivity can be maintained without impairing electric power for radio waves.

6. Modification Example of Resin Frame 80

Figure 15:
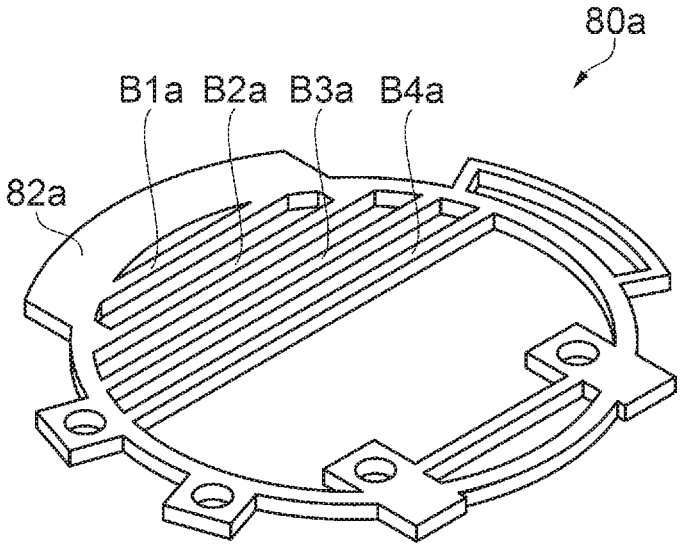
FIG. 15 is perspective view showing the schematic configuration of a modification example of the resin frame.

Next, with reference to FIG. 15, an outline of a modification example of a resin frame (the resin frame 80 in the embodiment) constituting the antenna structure (GPS antenna 90) according to the invention will be described. FIG. 15 is perspective view showing the schematic configuration of a modification example of the resin frame. In the following description, the description is focused on the form and configuration which are different from the above-described embodiment, and the same forms and configurations are denoted by the same reference numerals and the explanation thereof may be omitted.

The resin frame 80*a* according to the modification example is made of the same material as the resin frame 80 of the aforementioned embodiment, and as shown in FIG. 15, it includes an outer peripheral frame portion 82*a*, a plurality of blocks B1*a*, B2*a*, B3*a*, and B4*a*. In the resin frame 80*a* according to the present modification example, the blocks B1*a*, B2*a*, B3*a*, and B4*a* whose both ends are connected to the outer peripheral frame portion 82*a* forma substantially linear shape and each have a gap. For convenience of illustration, four blocks B1*a*, B2*a*, B3*a*, and B4*a* have been described, but the number of blocks is not limited thereto. Further, the width dimension of the block is not limited. In this way, the resin frame 80*a* of the present modification example has a skeleton shape by the outer peripheral frame portion 82*a* and the blocks B1*a*, B2*a*, B3*a*, and B4*a*.

Further, even in the resin frame 80*a*, the resonance frequency of the GPS antenna 90 (antenna electrode 91) is varied, by cutting off one of the plurality of blocks such as the blocks B1*a*, B2*a*, B3*a*, and B4*a* as necessary. As described above, the resonance frequency of the GPS antenna 90 (antenna electrode 91) can be adjusted so as to be included within the predetermined frequency range, similar to the aforementioned embodiment, by cutting off one of the blocks B1*a*, B2*a*, B3*a*, B4*a*, or the like of the resin frame 80*a* as necessary.

In the above description, the GPS using the GPS satellite 8 as the position information satellite included in the global navigation satellite system (GNSS) has been described as an example, but this is only an example. The global navigation satellite system may include other systems such as Galileo (EU), GLONASS (Russia), and Hokuto (China), stationary satellites such as SBAS, and a position information satellite that transmits satellite signals, such as a quasi-zenith satellite. That is, the wrist device 200 may be configured to acquire any one of date information, time information, position information and speed information which are obtained by processing radio waves (radio signals) from a position information satellite including a satellite other than GPS satellite 8. In addition, the global navigation satellite system can be a regional navigation satellite system (RNSS). In this case, the antenna structure described above can be an antenna corresponding to various regional navigation satellite systems (RNSS).

In addition, in the above description, the resonance frequency of the antenna structure (GPS antenna 90) is adjusted, by cutting off one of the plurality of blocks B1, B2, B3, B4, and B5 (B1*a*, B2*a*, B3*a*, and B4*a*) of the resin frame 80 (80*a*). Instead of this, the resonance frequency of the antenna structure (GPS antenna 90) may be adjusted by preparing a plurality of resin frames having different block shapes and replacing the resin frames having different block shapes as necessary such that the amount of change in frequency when blocks are placed between the antenna electrode 91 and the circuit board 45 including the ground conductor portion 92 is different.

What is claimed is:

1. An antenna structure comprising:

a plate-shaped conductor element;

a plate-shaped element including a ground conductor portion disposed so as to overlap with the conductor element in plan view; and a skeletal resin frame for frequency adjustment disposed between the conductor element and the ground conductor portion, wherein the skeletal resin frame includes a frame portion, a plurality of blocks, and a plurality of beams connecting the frame portion to the plurality of blocks, and the frame portion, the plurality of blocks, and the plurality of beams are made of the same material.

2. The antenna structure according to claim 1, wherein a dissipation factor of the resin frame is tan δ, and the following relationship is satisfied: tan $\delta \leq 0.001$.

3. The antenna structure according to claim 2, wherein the plate-shaped element including the ground conductor is a circuit board.

4. The antenna structure according to claim 1, wherein the plate-shaped element including the ground conductor is a circuit board.

5. The antenna structure according to claim 1, further comprising a short circuit element which connects the conductor element and the ground conductor portion, the short circuit element including a plurality of connection portions.

6. A portable electronic device comprising:

the antenna structure according to claim 1.

7. The portable electronic device according to claim 6, further comprising a display disposed so as to overlap the antenna structure.

8. The portable electronic device according to claim 7, wherein at least a part of an outer edge region of the antenna structure protrudes outward beyond an outer edge of the display in plan view.

9. The portable electronic device according to claim 7, wherein the display is any one of a liquid crystal display, an organic EL display, and an EPD.

10. The portable electronic device according to claim 7, further comprising a holding frame to which the antenna structure is attached and that holds an outer edge portion of the display.

11. A frequency adjustment method of an antenna structure including a plate-shaped conductor element, a plate-shaped element including a ground conductor portion, and a skeletal resin frame including a plurality of blocks for frequency adjustment, wherein the skeletal resin frame includes a frame portion, a plurality of blocks, and a plurality of beams connecting the frame portion to the plurality of blocks, and the frame portion, the plurality of blocks, and the plurality of beams are made of the same material, the method comprising:

connecting the conductor element and the plate-shaped element, which are disposed to overlap in plan view, with a short circuit element;

placing the resin frame between the conductor element and the ground conductor portion;

measuring a resonance frequency of the conductor element; and adjusting the resonance frequency such that the resonance frequency is within a predetermined frequency range by cutting off one of the plurality of blocks specified based on the measured resonance frequency.

12. The frequency adjustment method of an antenna structure according to claim 11, wherein in the adjusting of the resonance frequency, each of the plurality of blocks is correlated in advance with a respective frequency variation amount resulting from cutting off each of the plurality of blocks, one or more blocks to be cut off from the plurality of blocks are specified depending on a frequency adjustment amount required to bring the resonance frequency within the predetermined frequency range, and the one or more blocks are cut off.

13. An antenna structure comprising:

a first element having conductive properties;

a second element including a ground conductor portion disposed so as to overlap with the first element in plan view; and a frequency adjustment frame sandwiched between the first element and the ground conductor portion of the second element, the frequency adjustment frame including a plurality of blocks spaced from each other, each of the blocks having a different shape and/or mass.

14. A frequency adjustment method of an antenna structure including a first element having conductive properties, a second element including a ground conductor portion, and a frequency adjustment frame including a plurality of blocks for frequency adjustment, the blocks being spaced from each other, the method comprising:

connecting the first element and the second element, which are disposed to overlap in plan view, with a short circuit element;

placing the frequency adjustment frame sandwiched between the first element and the ground conductor portion of the second element;

measuring a resonance frequency of the first element; and adjusting the resonance frequency such that the resonance frequency is within a predetermined frequency range by cutting off one or more of the plurality of blocks specified based on the measured resonance frequency, each of the plurality of blocks having a different shape and/or mass such that each of the plurality of blocks is correlated in advance with a different frequency variation amount.

* * * * *